US007785394B2

(12) United States Patent
Chesonis et al.

(10) Patent No.: US 7,785,394 B2
(45) Date of Patent: Aug. 31, 2010

(54) SYSTEM AND METHOD FOR IN-LINE MOLTEN METAL PROCESSING USING SALT REACTANT IN A DEEP BOX DEGASSER

(75) Inventors: Dawn Corleen Chesonis, Avonmore, PA (US); David H. DeYoung, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 12/035,848

(22) Filed: Feb. 22, 2008

(65) Prior Publication Data

US 2008/0202290 A1 Aug. 28, 2008

Related U.S. Application Data

(60) Provisional application No. 60/891,310, filed on Feb. 23, 2007.

(51) Int. Cl.

| | |
|---|---|
| ***C22B 9/05*** | (2006.01) |
| ***C22B 9/10*** | (2006.01) |
| ***C22B 21/06*** | (2006.01) |
| ***C22B 26/22*** | (2006.01) |

(52) U.S. Cl. ..... 75/414; 75/603; 75/682

(58) Field of Classification Search ..... 75/414, 75/603, 682

See application file for complete search history.

(56) References Cited

U.S. PATENT DOCUMENTS 3,767,382 A 10/1973 Bruno et al.

(Continued)

FOREIGN PATENT DOCUMENTS

CA 2272976 11/1999

(Continued)

OTHER PUBLICATIONS

Sébastien Leboeuf, Claude Dupuis, Bruno Maltais, Marc-André Thibault, Einar Smarason, In-Line Salt Fluxing Process; Light Metals 2007 TMS (The Minerals, Metals & Materials Society); Feb. 25, 2007; pp. 623-628; Alcan International Ltd. (Arvida Research and Development Centre), Québec, Canada; STAS (Société des Technologies de l' Aluminium du Saguenay Inc.) Québec, Canada; Alcan Iceland Ltd. (ISAL) Harnarfjördur, Iceland.

(Continued)

*Primary Examiner*—George Wyszomierski
*Assistant Examiner*—Tima M McGutthry-Banks
(74) *Attorney, Agent, or Firm*—Greenberg Traurig, LLP

(57) ABSTRACT

An in-line deep box treatment of molten metal wherein, instead of gaseous $Cl_2$, a solid salt reactant containing a halide salt (e.g., $MgCl_2$) as one of its components may be injected into the molten metal along with an inert gas (typically argon) through the existing degasser impellor. The salt flux may be metered into the inert gas stream at a controlled rate. A salt injector flux tank may be retrofitted to current rotary degassing equipments without requiring a specialized rotor design or changes in the degasser unit design. Using the halide salt-based solid flux, the benefits of alkali, alkaline earth, and inclusion removal may be achieved without the industrial hygiene, environmental, and safety issues associated with storing and using the gaseous and hazardous $Cl_2$ during molten metal degassing.

11 Claims, 10 Drawing Sheets

U.S. PATENT DOCUMENTS

| | | | | |
|---|---|---|---|---|
| 3,870,511 | A | 3/1975 | Szekely | |
| 4,203,581 | A | 5/1980 | Pelton | |
| 4,373,704 | A | 2/1983 | Pelton | |
| 4,832,740 | A * | 5/1989 | Meier | 75/683 |
| 5,494,265 | A | 2/1996 | Ventre | |
| 5,527,381 | A | 6/1996 | Waite et al. | |
| 5,660,614 | A | 8/1997 | Waite et al. | |
| 5,968,223 | A | 10/1999 | Eckert | |
| 6,056,803 | A | 5/2000 | Waite | |
| 6,375,712 | B1 * | 4/2002 | Forberg et al. | 75/680 |
| 6,589,313 | B2 | 7/2003 | Bilodeau et al. | |
| 6,887,424 | B2 | 5/2005 | Ohno et al. | |
| 6,960,239 | B2 | 11/2005 | Bilodeau et al. | |
| 2002/0096810 | A1 | 7/2002 | Bilodeau et al. | |
| 2008/0307927 | A1 * | 12/2008 | Dupuis et al. | 75/680 |

FOREIGN PATENT DOCUMENTS

| | | |
|---|---|---|
| EP | 0395138 | 10/1990 |
| EP | 1462530 | 9/2004 |
| JP | 63183136 | 7/1988 |
| JP | 07207373 | 8/1995 |
| WO | 2006109810 | 10/2006 |
| WO | 2007/048240 A2 | 5/2007 |

OTHER PUBLICATIONS

S. Leboeuf, P. Waite, C. Dupuis; Towards Chlorine-Free Casthouses; Met Soc, Aluminium 2006, 45th Annual Conference of Metallurgists of CIM; Oct. 1, 2006; pp. 851-861; Alcan International Limited, Arvida Research and Development Centre; Québec, Canada.

International Search Report issued in the corresponding International Patent Application No. PCT/US2008/054730 on Jun. 23, 2008.

"Salt Fluxes for Alkali and Alkaline Earth Element Removal from Molten Aluminum", 7th Australian Asian Pacific Aluminum Cast House Technology Conference, 2001, pp. 99.

"An Evaluation of a Snif Unit as an Inclusion Removal and Degassing Device", Eister, W. C. and Krumme, W. R., Light Metals 1991, p. 1171.

"Theoretical and Experimental Investigation of Furnace Chlorine Fluxing," Celik, C. and Doutre, D., Light Metals 1989, p. 793.

"Replacing Ceramic Foam Filtration by an Alpur® S1000 In-line Treatment: A Winning Bet at Cableries de Lens," Ventre, I. and Rolland, J., Light Metals 1995, p. 1245.

* cited by examiner

SYSTEM AND METHOD FOR IN-LINE MOLTEN METAL PROCESSING USING SALT REACTANT IN A DEEP BOX DEGASSER

CROSS REFERENCE TO RELATED APPLICATIONS

The present invention claims benefit of U.S. Provisional Application Ser. No. 60/891,310, entitled "SYSTEM AND METHOD FOR IN-LINE MOLTEN METAL PROCESSING USING SALT REACTANT" filed on Feb. 23, 2007, which, is incorporated herein.

FIELD OF THE DISCLOSURE

In one embodiment, the present disclosure relates to an apparatus and method for processing a molten metal that eliminates the use of Chlorine gas ($Cl_2$). In another embodiment, the present disclosure relates to a molten metal degassing methodology using salt reactant to replace Chlorine gas ($Cl_2$).

BACKGROUND

An in-line degassing operation is usually done by insufflation of an appropriate inert gas containing some percentage of Chlorine ($Cl_2$) gas. The Chlorine gas forms as small bubbles in the molten metal. The degassing is generally done in a continuous operation just before the casting, which may itself be done continuously. A mixture of inert gas and $Cl_2$ (Chlorine) is injected into the molten metal to treat the molten metal as it flows from the furnace to the casting pit. While inert gas alone can effectively remove dissolved $H_2$ (hydrogen) through mass transfer, removing alkali and alkaline earth impurities (such as sodium (Na), lithium (Li), and calcium (Ca)) in the molten metal requires a chemical reactant such as $Cl_2$, as given by the following reactions:

$$2Na+Cl_2 \rightarrow 2NaCl \text{ and}$$

$$Ca+Cl_2 \rightarrow CaCl_2$$

Chlorine ($Cl_2$) may also improve the floatation and removal of non-metallic inclusions, providing improved metal cleanliness.

However, the use of gaseous $Cl_2$ represents an environmental and industrial hygiene issue. Gaseous Chlorine is also a source of regulated air emissions. Furthermore, because of the hazardous nature of $Cl_2$, the storage, piping, safety, and training requirements can also be stringent. Also, $Cl_2$ can cause increased corrosion and wear of other equipment in a plant. Thus, it may be desirable to remove alkali and alkaline earth metals from molten aluminum and its alloys in-line without the use of $Cl_2$.

To achieve effective degassing, all degassing apparatus must deliver a certain minimum volume of gas per kilogram of metal. Degassing can be performed in a trough-like or a deep box degasser. A trough-like degasser is a degasser with a static volume/dynamic volume ratio less than at least 50% of a deep box degasser static volume/dynamic volume ratio and one which retains little if any metal when the source of metal is interrupted after the degassing operation is completed. In a trough-like degasser where the residence time of the metal in the region in which, the gas is supplied is substantially less than in the deep box degassers, the amount of gas which each rotary injector must deliver is high and the ability to deliver a suitable amount of gas determines the effectiveness of an injector design.

It has been noticed that in a trough-like degasser with gas rotors capable of delivering a suitable volume of gas to a molten metal that gases tends to be released from the rotors in an irregular manner causes splashing at the surface of the molten metal and inefficiency of dissolved gas removal. Some trough-like degassers use several relatively small rotary gas injectors along the length of a trough section to achieve the equivalent of a continuous or pseudo "plug" flow reactor rather than a well-mixed flow reactor or continuous stirred-tank reactor (CSTR), which is characteristic of deep box degassers. In an ideal plug-flow reactor there is no mixing and the fluid elements leave in the same order they arrived. Therefore, fluid entering the reactor at time t will exit the reactor at time $t+\tau$, where $\tau$ is the residence time of the reactor ($E(t)=\delta(t-\tau)$). An ideal continuous stirred-tank reactor is based on the assumption that the flow at the inlet is completely and instantly mixed into the bulk of the reactor. The CSTR and the outlet fluid have identical, homogeneous compositions at all times. An ideal CSTR has an exponential residence time distribution ($(E(t)=(1/\tau)e^{(-t/\tau)})$).

However, trough-like degassers with a plurality of small rotary gas injectors are not capable of delivering large volumes of gas in the form of fine bubbles into molten metal without substantial irregularities of gas flow and are not suitable for use in any application in which such high gas delivery in the form of fine bubbles is required. FIGS. 1A and 1B illustrate that a deep box degasser (such as Alcoa A622) is more efficient to remove Hydrogen and inclusions from molten metal than a trough-like degasser (such as ACD) when chlorine is used as a degassing agent. The same results are expected when chlorine is replaced by a salt flux mixture. Therefore, deep box degassers must be utilized to reduce splashing at the surface of the molten metal and to maximize the efficiency of dissolved gas and inclusion removal.

SUMMARY

In one embodiment, the present disclosure relates to a method of processing a molten metal in an in-line metal treatment apparatus without the use of Chlorine gas ($Cl_2$) having a compartment containing the molten metal and a rotating impeller immersed into the molten metal, and a storage tank capable of entraining or holding a salt reactant or flux (the terms reactant and flux are used interchangeable throughout this application) and an inert gas (e.g., Argon gas). In a further embodiment, the method comprises injecting a predetermined amount of a mixture of an inert gas and salt reactant containing, for example, a halide salt into the molten metal in the compartment through the rotating impeller immersed into the molten metal. In yet another embodiment, the method includes the step of further injecting the salt reactant at a controlled rate into the molten metal through the rotating impeller.

A further disclosure of one of the embodiments is an in-line degassing system that includes a compartment containing the molten metal; a rotating impeller having a hollow shaft being capable of immersion into the molten metal; and a storage tank having an outlet portion coupled to the hollow shaft via a flow regulator. The storage tank is configured to store an inert gas and a salt reactant containing, for example, a halide salt. In one embodiment of the storage tank, the flow regulator is configured to allow injection of a combination of the inert gas and the salt reactant from the storage tank into the molten metal via the hollow shaft of the rotating impeller immersed in the molten metal, wherein a fluidized solid salt reactant replaces the Chlorine gas.

In one embodiment, the present disclosure relates to a safer and non-hazardous alternative (non-chlorine salt reactant) to gaseous $Cl_2$ in in-line degassers. In another embodiment, a halide salt-based selected alternative may be industrially hygienic, safe to store, and capable of removing alkali and alkaline earth metals from molten aluminum and its alloys in-line at least as efficiently as gaseous $Cl_2$.

BRIEF DESCRIPTION OF THE DRAWINGS

For the present disclosure to be easily understood and readily practiced, the present disclosure will now be described for purposes of illustration and not limitation, in connection with the following figures, wherein.

Figure 1A:
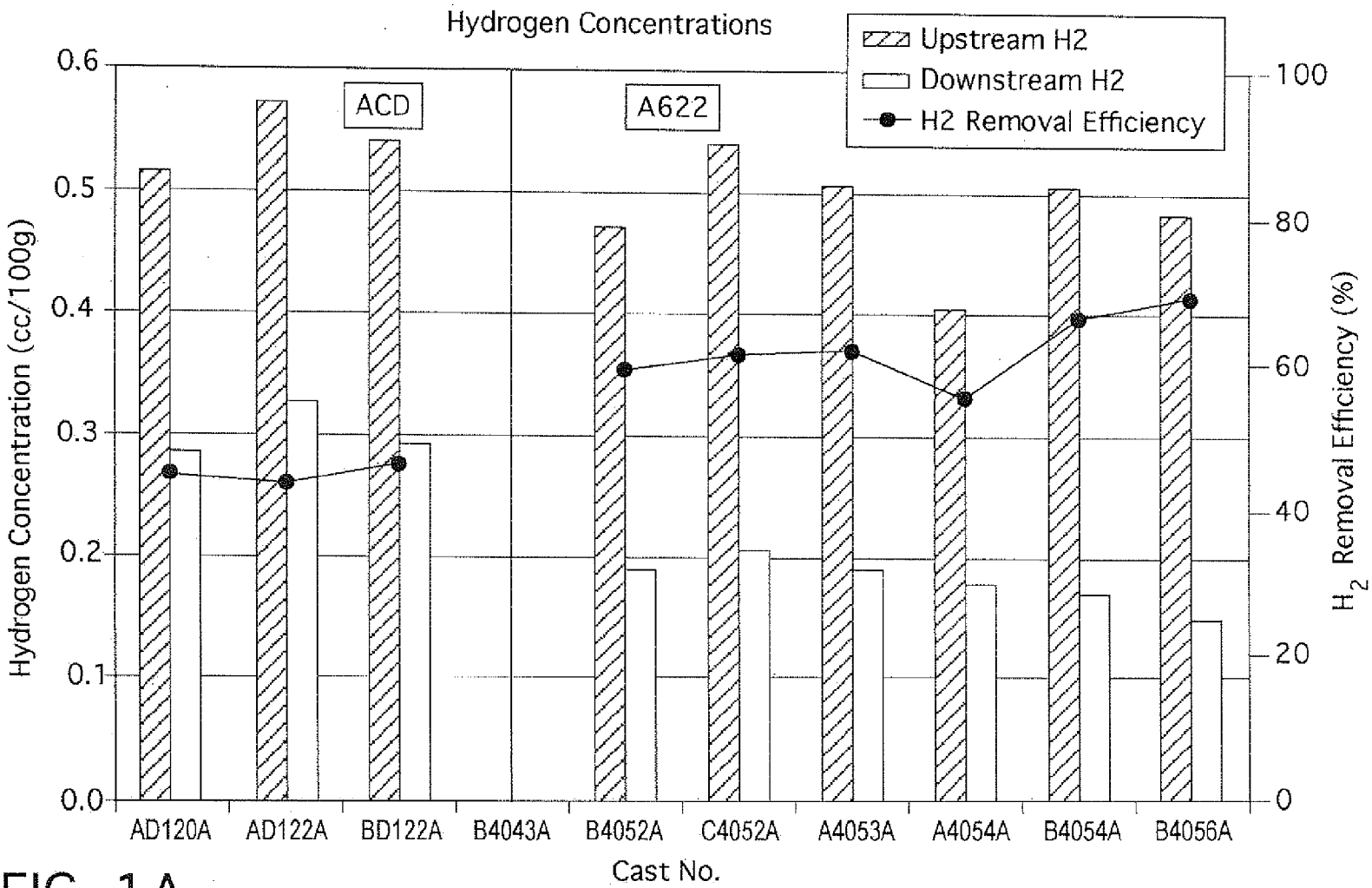
FIGS. 1A and 1B illustrate that a deep box degasser (such as Alcoa A622) Hydrogen removal efficiency and inclusion concentrations after filtration compared to a trough-like degasser (such as ACD) when chlorine is used as a degassing agent.
Figure 1B:
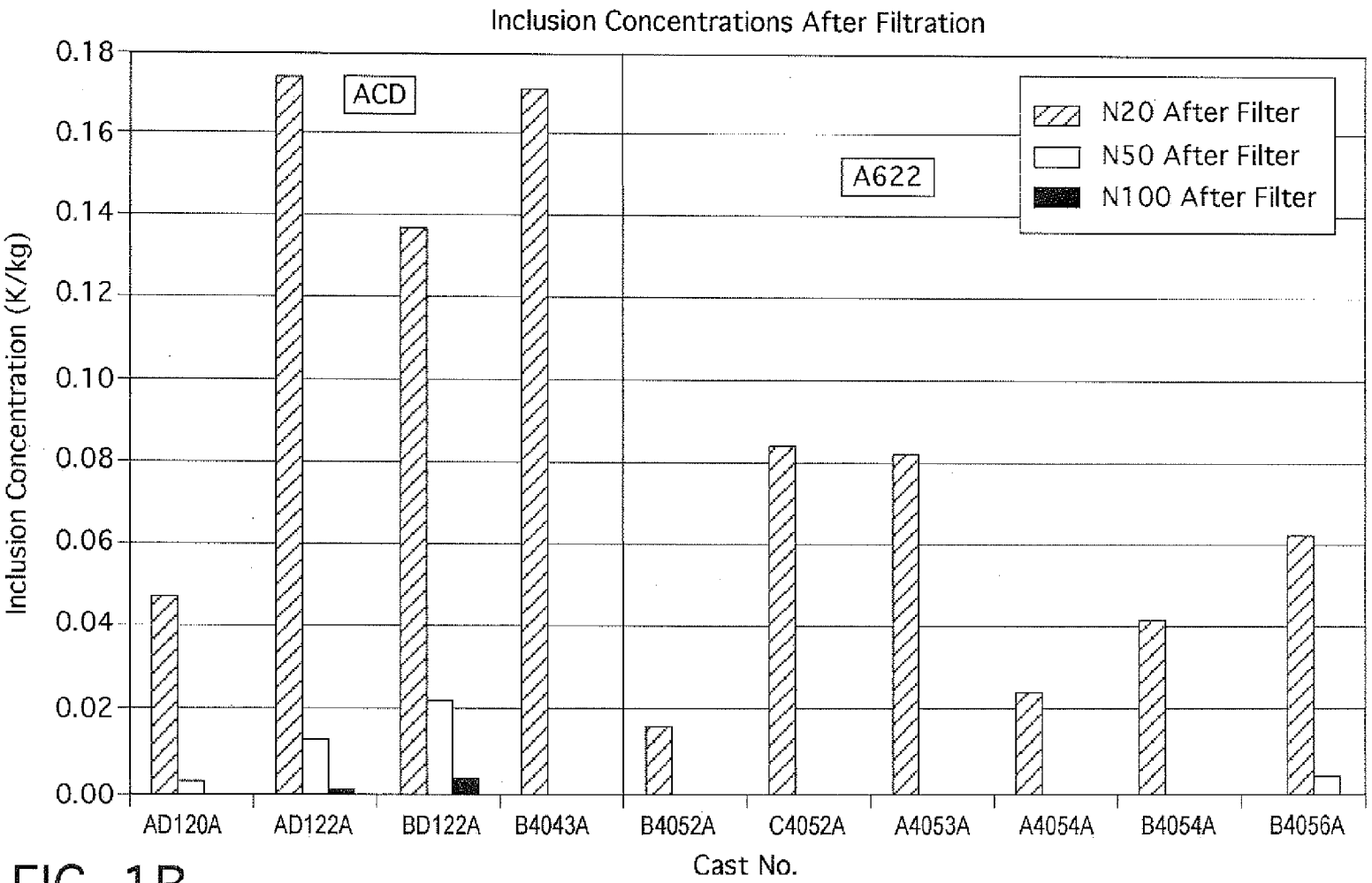

Among those benefits and improvements that have been, disclosed, other objects and advantages of this invention will become apparent from the following description taken in conjunction with the accompanying drawings. The drawings constitute a part of this specification and include exemplary embodiments of the present invention and illustrate various embodiments and features thereof.

DETAILED DESCRIPTION

The accompanying figures and the description that follows set forth the present disclosure in embodiments of the present disclosure. However, it is contemplated that persons generally familiar with melting, casting, filtration, and degassing of molten metals will be able to apply the teachings of the present disclosure in other contexts by modification of certain details. Accordingly, the figures and description are not to be taken as restrictive on the scope of the present disclosure, but are to be understood as broad and general teachings. In the discussion herein, when any numerical range of values is referred, such range is understood to include each and every member and/or fraction between the stated range of minimum and maximum. Finally, for purpose of the description hereinbelow, the terms "upper," "lower," "right," "left," "vertical," "horizontal," "top," "bottom," and derivatives thereof shall relate to the present disclosure as it is oriented in the drawing figures provided herein.

The present disclosure relates to an in-line treatment of molten metal wherein, instead of gaseous $Cl_2$, a predetermined amount of a solid salt reactant or flux containing, for example, a halide salt (e.g., $MgCl_2$) as one of its components may be injected into the molten metal along with an inert gas (typically argon). The inert gas stream to the degasser, which is used for H2 removal, may also be used to fluidize and transport the solid salt reactant. The salt reactant may be metered into the inert gas stream at a controlled rate. The salt reactant may react with alkali and alkaline earth metals to remove them from the molten metal as chlorides. The removal of alkali and alkaline earth may be equal to that attained with the equivalent amount of gaseous $Cl_2$ where, for example, a halide salt-based reactant is used instead of gaseous $Cl_2$ according to one embodiment of the present disclosure. Thus, using the halide salt-based solid flux as per the teachings of one embodiment of the present disclosure, the benefits of alkali, alkaline earth, and inclusion removal may be achieved without the industrial hygiene, environmental, and safety issues associated with storing and using the gaseous and hazardous $Cl_2$ during molten metal degassing. Molten metal is defined as an alloy, for example aluminum or any aluminum alloy, at a temperature above the melting or liquidus temperature.

In case of molten aluminum, for example, the following chemical reaction may illustrate how $MgCl_2$ removes alkali and alkaline earth impurities (e.g., Na and Ca) from the molten aluminum:

$$2Na+MgCl_2 \rightarrow 2NaCl+Mg$$

$$Ca+MgCl_2 \rightarrow CaCl_2+Mg$$

Thus, the alkali and alkaline earth metals are removed from the molten metal as chlorides. Other components of the injected salt lower the melting point of the salt mixture (including the halide salt, e.g., $MgCl_2$) to a value that allows the injected salt to remain molten at the metal temperature, thereby allowing the salt to be dispersed throughout the molten metal. Thus, a solid salt reactant may be used as a chemical reactant rather than gaseous chlorine to carryout molten metal cleaning. In place of $MgCl_2$, various other halide salts may be used as part of the solid salt reactant including, for example, potassium chloride (KCl), aluminum fluoride ($AlF_3$), sodium chloride (NaCl), calcium chloride ($CaCl_2$), sodium fluoride (NaF), calcium fluoride ($CaF_2$), etc.

A salt is generally an ionic compound composed of cations (positively charged ions, such as sodium ($Na^+$), calcium ($Ca^{2+}$), magnesium ($Mg^{2+}$), potassium ($K^+$), etc.) and anions (negative ions such as chloride ($Cl^-$), oxide ($O^{2-}$), fluoride ($F-$), etc.) so that the product is neutral (without a net charge). In the halide salts of the present disclosure, the component anions are inorganic (e.g., $Cl^-$ based). Salts are typically formed when acids and bases react. A halide, on the other hand, is a binary compound, of which one part is a halogen atom and the other part is an element or radical that is less electronegative than the halogen, to make a fluoride, chloride, bromide, iodide, or astatide compound. The halide anions are fluoride ($F^-$), chloride ($Cl^-$), bromide ($Br^-$), iodide ($I^-$) and astatide ($At^-$). Such ions are present in all ionic halide salts.

In one embodiment of the present invention, a blended salt containing about 75% of $MgCl_2$, 15%) of KCl, and 10% of NaCl may be used as the salt reactant. In another embodiment, a blended salt (referred to hereinbelow as salt flux "AEP-27") containing about 40% of $MgCl_2$ and 60% of KCl may be used as the salt flux. In a further embodiment, a fused salt (referred to hereinbelow as salt flux "AEP-40") containing about 40% of $MgCl_2$ and 60% of KCl may be used as the salt flux. In yet another embodiment, a blended salt containing about 70% of $MgCl_2$ and 30% of KCl may be used as the salt flux. In a further embodiment, a blended salt containing about 20% of $MgCl_2$ and about 80% of KCl may be used as the salt flux.

In one embodiment of the present invention, the grain size of the salt flux (including the halide salt) may be in the range of about 1 to 3 mm. In a further embodiment, the salt flux may contain magnesium chloride mixed with potassium chloride, wherein magnesium chloride may represent about 40% to 60% portion of the salt reactant. In one embodiment of the present invention the grain size of each $MgCl_2$ flake can be less than about ¼".

The flux feed rate may be adjusted in the range of about 1 to 15 grams per minute, with a minimum allowable rate of about 0.5 grams per minute and a maximum allowable flux feed rate of about 20 grams per minute, with a maximum about 100 grams per minute. In one embodiment, the feed rate accuracy may be in the range of about +/−5%. The salt flux may be pre-packaged in bags of about 1.0 lb (around 5 kg) capacity, or, it may be prepared at the time of degassing operation in the desired quantity.

In one embodiment of the present invention, the flow rate of the inert gas (e.g., argon) into the molten metal may be adjusted to about 150 scfh, with a minimum allowable rate of about 20 scfh and a maximum allowable rate of about 200 scfh (where "scfh" refers to "cubic feet per hour at standard conditions"). The accuracy of adjustment of inert gas flow rate may be about +/−5% to +/−1% of the flow rate.

Figure 2:
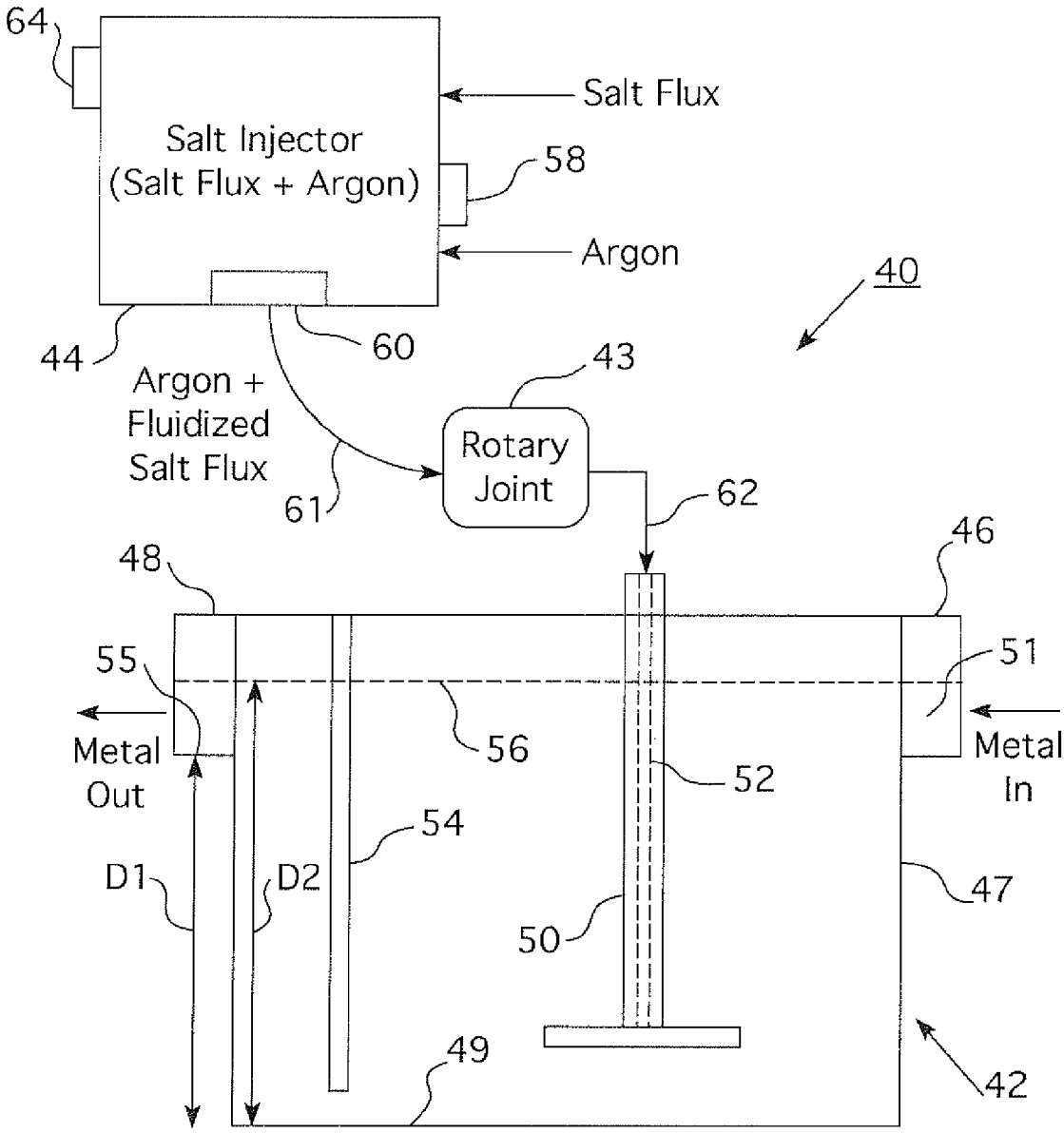
FIG. 2 depicts a schematic of a halide salt-based molten metal processing system according to one embodiment of the present disclosure.

Now turning to FIG. 2, a schematic of a salt reactant molten metal processing system 40 according to one embodiment of the present disclosure is shown. In one embodiment, the molten metal may include aluminum or its alloys, magnesium or its alloys, etc. In a further embodiment, the system 40 is shown to include an in-line molten metal processing unit 42, such as a degassing unit, coupled to a storage tank or salt injector tank 44 via a coupling unit or rotary joint 43. Though the present disclosure describes a degassing unit, other in-line molten metal processing units are within the contemplation of the invention. Only an exemplary schematic is provided for the degasser unit 42 in FIG. 2. In one embodiment, the in-line degasser 42 may typically provide treatment of molten metal by injecting non-chlorine based fluidized reactants (discussed later below) along with an inert gas (e.g., argon) through the hollow shaft (discussed in more detail below) of a rotating impeller or rotor 50. In another embodiment, the raw molten metal 51 to be processed may be received through the inlet port 46, whereas the processed molten metal 53 exits through the outlet port 48 for further downstream processing (e.g., casting). During processing, the molten metal—raw as well as processed—remains contained in a compartment 47. It is noted that the inlet port 46 and the outlet port 48 in the degassing unit 42 in FIG. 2 are placed on opposite faces of the compartment 47. However, in an alternative embodiment, other placement of these ports may be conceived as per the design requirements of the in-line metal processing set-up. It is further noted that the salt reactant-based treatment methodology discussed herein relates to the treatment of the raw molten metal 51 before it is converted into the processed molten metal 53.

In one embodiment, the rotor 50 in the in-line metal processing unit 42 is further shown to include a duct 52, which may be formed by making the rotor shaft hollow from inside. In an alternative embodiment, the duct 52 may act as a conduit for the combination of the inert gas and the fluidized reactants received from the salt injector 44 (discussed in more detail below) through the rotary joint 43, which may be in fluid communication with the duct 52. In a further embodiment, a baffle 54 may be provided to partition the inlet and outlet portions of the compartment 47. In one embodiment, the degasser 42 may also include heater elements or immersion heaters (not shown) to maintain or control the temperature of the molten metal prior to, during, and/or after the degassing operation. In FIG. 2, the reference numeral "56" is used to indicate a representative level of the molten metal in the compartment 47. Compartment 47 has a static volume when molten metal is not flowing and a dynamic volume when molten metal is flowing. Static volume of the compartment 47 is proportional to Distance D1 (static depth of compartment 47), measured from the bottom 49 of compartment 47 to the bottom 55 of the outlet trough 48. Dynamic volume of the compartment 47 is proportional to Distance D2 (dynamic depth of molten metal), measured from the bottom 49 of compartment 47 to the metal level 56. A deep box degasser is defined by the static depth to dynamic depth (D1/D2) ratio greater than 0.5. A trough-like degasser is defined by the static depth to dynamic depth (D1/D2) ratio less than 0.5. This metal level is for illustration only. In practice, the molten metal level may vary from that indicated in FIG. 2 depending on, for example, the molten metal processing requirements in a particular plant, the processing capacity of a degasser in operation, etc.

In one embodiment, the metal processing unit 42 may be an in-line degasser with, a covered top (not shown) for improved performance. Similar additional constructional and operational details of the unit 42 are also not shown in FIG. 2 nor are they discussed herein. Furthermore, it is noted here that, in one embodiment, all of the heater assemblies (not shown) may be installed in proximity to the same wall of the compartment 47, or they may be disposed at other different locations throughout the compartment 47 as needed.

Also, in a further embodiment, the system 40 may include more than one processing compartment 47 (along with corresponding rotors and rotary joints for salt injection) to process a greater quantity of metal. Such additional compartments (not shown) may operate in series or in any other arrangement compatible with the desired operational requirements. Each such compartment may include a gas introducing device (similar to, for example, the rotor 50) and, possibly, one or more immersion heaters (not shown in FIG. 2) to control the temperature of the molten metal being processed. One processing compartment could contain more than one rotor and rotary joint.

In one embodiment, the degassing unit 42 may be obtained from a number of companies. Some exemplary models that may be used in the system 40 of FIG. 2 include, for example, the Alcoa A622 unit, the Pechiney Alpur unit, and the Pyrotek SNIP system.

Additional discussion of operational details for the molten metal processing system 40 in FIG. 2 is provided below in conjunction with discussion of FIG. 3, which illustrates an exemplary flow of operations in the example of an in-line degassing system 40 of FIG. 2 according to one embodiment of the present disclosure. These operational steps are represented by blocks 70, 74, and 78 in FIG. 3. In particular, block 78 of FIG. 3 includes a solid salt reactant (either fused or physically blended) that contains a halide salt (e.g., magnesium chloride ($MgCl_2$)) as one of its components is fluidized and injected, along with an inert earner gas (e.g., Argon), through the duct 52 (FIG. 2) of the degasser impeller rotor 50 (FIG. 2) via the rotary joint 43 (FIG. 2). Fused salt means the individual components of the salt are mixed together, melted, solidified, crushed, and sized to form a homogeneous material. A physically blended salt means that grains of each component are mixed together to form a heterogeneous mixture of the two or more types of particles. As noted before, the present disclosure relates to in-line degassing without the use of gaseous chlorine.

Now returning to FIG. 2, one embodiment of the present invention illustrates that the storage tank 44 may receive a salt flux (containing the halide salt) from a first external supply source 32 and the inert gas (e.g., argon) from a second external supply source 33 as indicated by respective input arrows in FIG. 2. The salt flux and the inert gas may be supplied into the storage tank 44 via respective conduits or pipelines or hoses (not shown) connected to the storage tank 44. The argon may be used to pressurize the tank 44 and to convey the salt flux into the rotor 50. In yet another embodiment, a rotameter 58 may be attached to the salt injector tank 44 and coupled to the argon inlet conduit (not shown) to control the Ar flow rate into the tank 44 so as to maintain appropriate pressure inside the tank 44. For example, if salt flux inside the tank 44 is reduced during operation, more Ar may be allowed into the tank 44 to maintain proper pressure (about 3 to 10 psig) inside the tank 44 and, hence, to facilitate further transport of the remaining salt flux to the rotor duct 52 with the help of the Ar gas. If Ar flow into the duct 52 is increased, then the rotameter 58 may be used to introduce more Ar into the tank 44 to maintain proper pressure within the tank. In one embodiment, the salt injector tank may be a suitably modified version of the Pyrotek™ FIM5 tank. The rotameter 58 may be calibrated for argon, and also for about 0 to 200 scfh of argon flow rate during flux injection. In one embodiment, a bypass gas feed line—indicated by an exemplary dotted line 35 in FIG. 2—may be provided to feed the argon directly into the rotary joint (i.e., without feeding the argon into the salt injector tank 44), for example, while the tank 44 is being depressurized and salt flux is being added to the tank 44. The rotameter 58 may be further calibrated for about 0 to 20 scfh of argon for bypass gas during loading of the flux into the tank 44.

In a further embodiment of the storage tank 44, a flow regulator 60 may also be provided inside or attached to an outlet port (not shown) of the salt injector 44 to control or regulate the salt feed rate of the salt flux going out of the salt injector 44. In one embodiment, the flow regulator 60 may also be used to control the rate of flow of Ar into the rotor duct 52 (via the rotary joint 43). In one embodiment, the flow regulator 60 is in the form of an auger (not shown). In another embodiment, the flow regulator 60 is in the form of a rotating cylinder with indentations (not shown). A suitable predetermined salt feed rate may be determined by weighing the amount of salt in the tank 44 at the beginning and at the end of each run.

Figure 3:
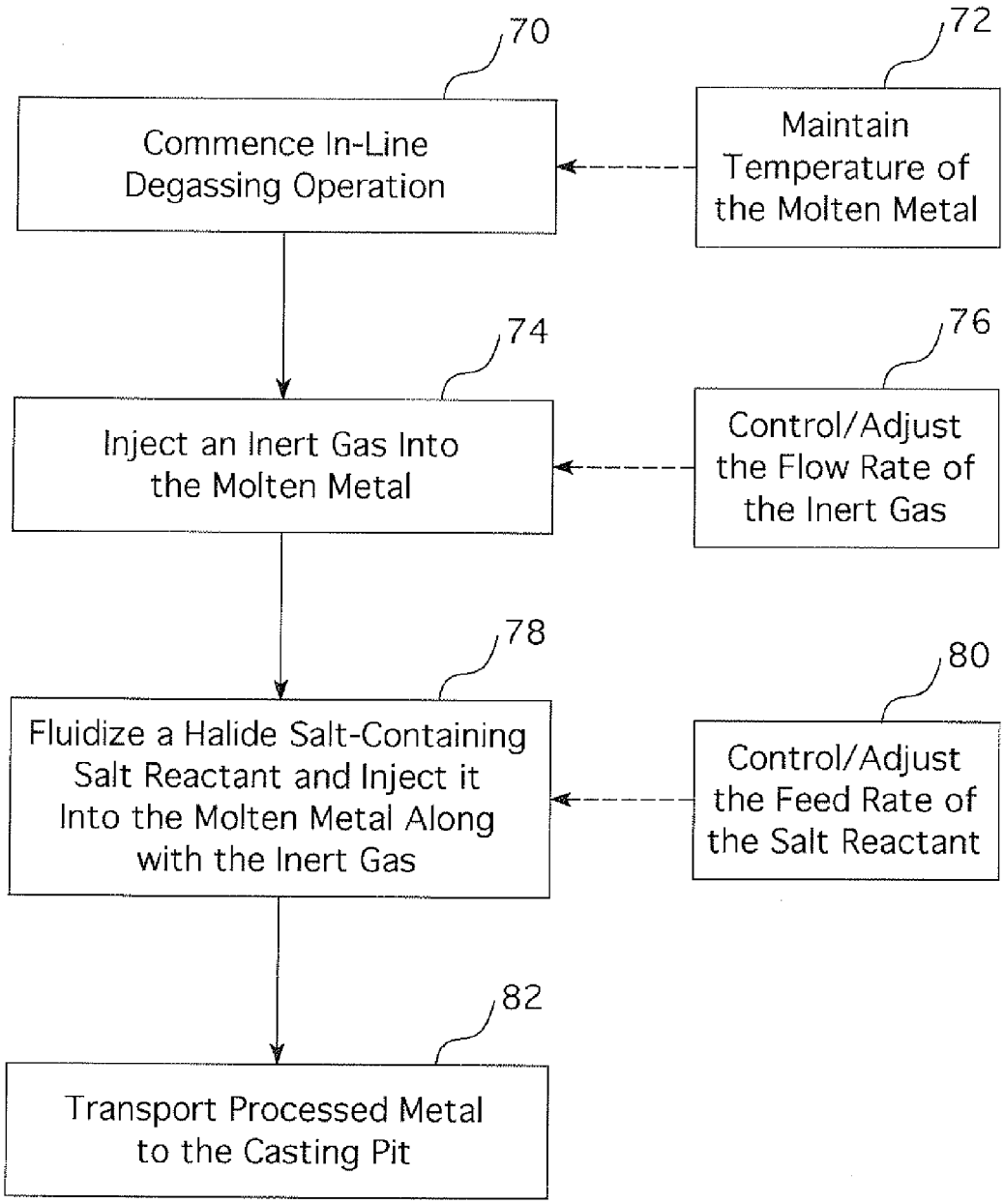
FIG. 3 illustrates an exemplary flow of operations in the in-line degassing system of FIG. 1 according to one embodiment of the present disclosure.

Referring to the operational flow in FIG. 3, it is observed here that the procedural steps indicated by blocks 72, 76, and 80 may be optionally performed during a degassing operation. For example, with the aid of a set of heater elements (not shown), the temperature of the molten metal may be maintained while the degassing operation is in process (block 72) as discussed before. Similarly, in one embodiment, the rate of flow of Ar gas and/or the feed rate of the fluidized salt flux (containing the halide salt) into the rotor duct 52 may also be adjusted (e.g., via the flow regulator 60) during the degassing operation as indicated at blocks 76 and 80, respectively. Alternatively, adjustments to the rate of argon flow or salt reactant feed rate may be earned out prior to commencement of degassing, and may not be further controlled during degassing. In another embodiment, the argon input may also be monitored and adjusted using the rotameter 58 as mentioned before. After conclusion of the degassing operation, the processed molten metal may be transported to the next process to be carried out in-line (e.g., the casting process) as indicated at block 82 in FIG. 3.

Returning to FIG. 2, a further embodiment of the present invention illustrates a sensor unit 64 may be provided on the salt injector tank 44 to monitor a number of sensing parameters. Although a single sensor unit 64 is shown in the embodiment of FIG. 2, it is noted here that the sensing functionalities associated with the sensor unit 64 (as described herein) may be implemented using a distributed sensing system having multiple sensors (not shown) located at different places on or around the salt injector tank 44. In one embodiment, the sensor unit 64 may contain one or more sensors to sense a number of parameters including, for example, the inlet pressure of the argon gas being received into the injector tank 44, the operating pressure inside the tank 44, the flux level inside the tank 44, etc. In one embodiment, the sensor unit 64 may be configured to provide alarms (e.g., visual or audible indications) to a user in a number of situations including, for example, when the argon inlet pressure is lower than a predetermined threshold value, when the tank operating pressure is lower than a first predetermined threshold or higher than a second predetermined threshold, or when the salt reactant level inside the injector tank is lower than a pre-set or desired level, etc. In one embodiment, the salt reactant level may be determined by weighing the flux. In another embodiment, the time and weight of flux for each 15 minute block and the total for the entire process cycle during flux feeding operation may be automatically recorded by a plant data acquisition system (not shown). In one embodiment, a remote data logging system (not shown) may be in communication with this plant data acquisition system, to receive data therefrom for further monitoring and analysis of the performance of the system 40. In a further embodiment, the flux tank 44 may be configured with a capacity to store about 50 to 100 lbs of salt flux.

In an alternative embodiment, the system 40 may be designed in such a manner that various electrical components therein are UL and CE approved devices that are compliant with US and EU (European Union) electric codes and operate at 110/220 VAC, 50-60 Hz. In a further embodiment, a universal connection, (not shown) may be provided on the tank 44 to allow connection of English or metric fittings of various pipes or conduits to be connected to the salt injector tank 44 (e.g., the argon inlet conduit or pipe, or the argon plus salt flux output pipe, etc.). In another embodiment, the tank 44 may be a powder coated pressure vessel with a maximum allowable tank pressure less than about 15 psig. In one embodiment, the tank 44 may be fitted with a pressure relief valve (not shown) to maintain desired steady-state as well as operating pressures. In one embodiment, the tank operating pressure can be in the range of about 3 to 7 psig. In an alternative embodiment, a sight window (not shown) may be provided on the tank 44 to allow visual inspection of the tank interior and its contents. In a further embodiment, a draining device (not shown) may be provided on the tank 44 to allow salt flux to be removed for maintenance or to change compositions of the salt reactant.

TEST EXAMPLES

The discussion herein relates to the comparative performance testing of in-line degassing operations using the conventional Ar—$Cl_2$ combination versus the Ar and the halide salt reactant combination as per the teachings of the present disclosure. It is observed from the performance data discussed below with reference to FIGS. 4 through 10 that injecting solid salt as described herein can provide removal of Na, Ca, and $H_2$ at least equal to that of an equivalent amount of gaseous $Cl_2$. The particulate emissions were the same as when $Cl_2$ was used and metal cleanliness was improved over gaseous $Cl_2$. These results thus indicate that the halide salt-based solid flux may be used as per the teachings of the present disclosure in place of gaseous and hazardous $Cl_2$ during molten metal degassing.

As shown in FIG. 2, the Ar and salt flux (containing the halide salt) combination from the salt injector tank 44 may flow into the rotary joint 43 via a conduit 61. In one test embodiment, the in-line degasser 42 was the Alcoa A622 unit, the rotor of which was coupled to a 1" diameter Barco rotary joint 43. The Ar and fluidized salt flux output from the flow regulator 60 were carried into the rotary joint 43 through a ¾ diameter rubber hose as a conduit 61. The Barco joint 43 in this embodiment was selected to allow the flow to be vertical downward through the joint rather than having a 90° turn as in case of standard Barco joints. The A622 rotor had a 4" diameter shaft and a 12" diameter impeller with a ½" diameter hole or duct through, the length of the shaft for the gas feed. The A622 was a single stage unit 26" wide by 36.88" long. Metal depth in the molten, metal compartment of the A622 unit ranged from about 26" when operated in batch mode to about 34" in dynamic mode. In the batch mode, the A622 degasser was filled with molten metal, but the metal did not flow through the unit. Whereas, in the dynamic mode, metal flowed from a 10,000 lb. furnace (not shown) through the A622 degasser into drain pans at a controlled rate of about 10,000 lb/hr. This A622 unit was heated with gas-fired immersion heaters and was not sealed or inerted. All tests used a rotor speed of about 170 rpm; Ar flow was about 350 scfh for the batch tests and about 300 scfh for the dynamic tests. These Ar flow rates were higher than typically used in an A622 because a high gas flow rate was required to pressurize the salt injection tank 44 and keep the feed lines (e.g., the conduit hose 61, and the feed line 62 connecting the rotary joint 43 with the rotor duct 52) from plugging.

In one test embodiment, the Amcor Injecta Model II flux injector was used as the salt injector tank 44 and filled with salt prior to each test. The Ar flow was used to pressurize the tank and to convey the salt into the rotor of A622. A rotameter (e.g., similar to the rotameter 58 in FIG. 2) attached to the Amcor flux injector controlled the Ar flow rate. An auger inside the flux injector controlled the salt feed rate. The average salt feed rate for each test was determined by weighing the amount of salt in the tank at the beginning and end of each test.

All tests discussed herein used aluminum alloy 5052, with about 2.5% Mg and 0.25% Cr. The initial phase of testing was done in the batch mode—the A622 degasser was filled with metal, but metal did not flow through the degasser. In the batch mode, Na and Ca were added to the metal before each test; quantometer samples were taken at 3 minute intervals to determine the Na and Ca removal rates. In the batch mode, the target for initial Na and Ca concentrations (in the molten metal) was about 0.005 wt. %. $Cl_2$ and salt feed rates were set to give approximately 100%) and 200%, respectively, of the stoichiometric requirement. In the test embodiment using the AEP-40 salt, the salt flowed through the rotor (of the A622 degasser unit) at the desired rate without plugging.

Figure 4A:
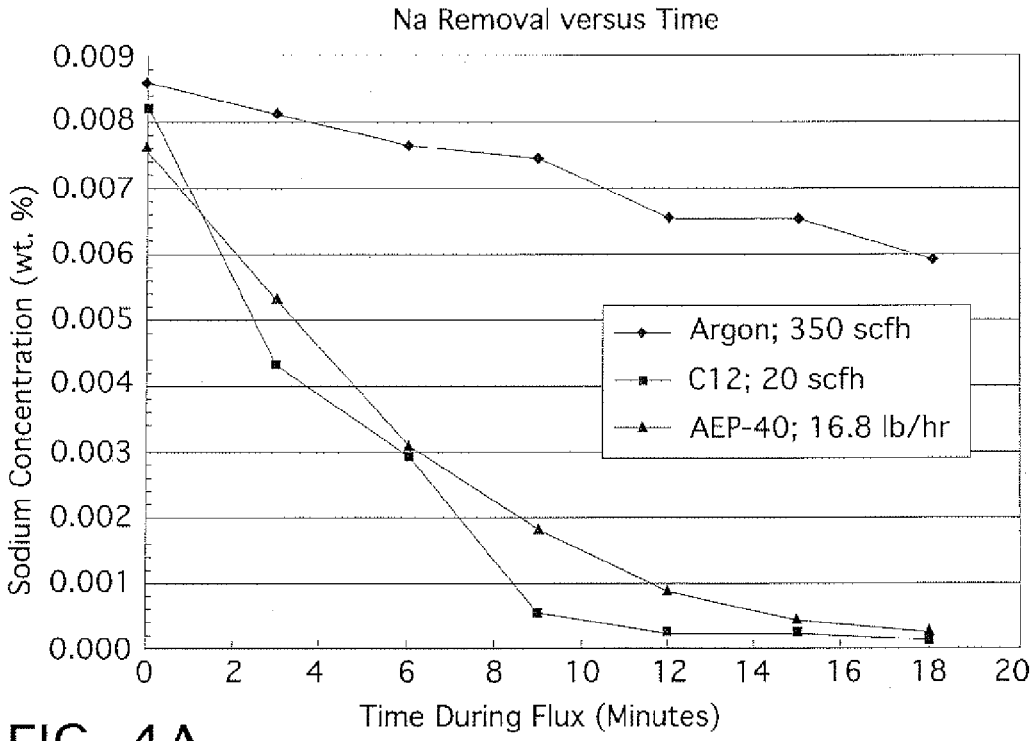
FIGS. 4A and 4B show examples of the Na and Ca concentrations, respectively, versus time for Ar alone, 20 scfh $Cl_2$ in Ar, and 16.8 lb/hr of about 40% $MgCl_2$-60% KCl salt in Ar in a batch mode testing according to one embodiment of the present disclosure.
Figure 4B:
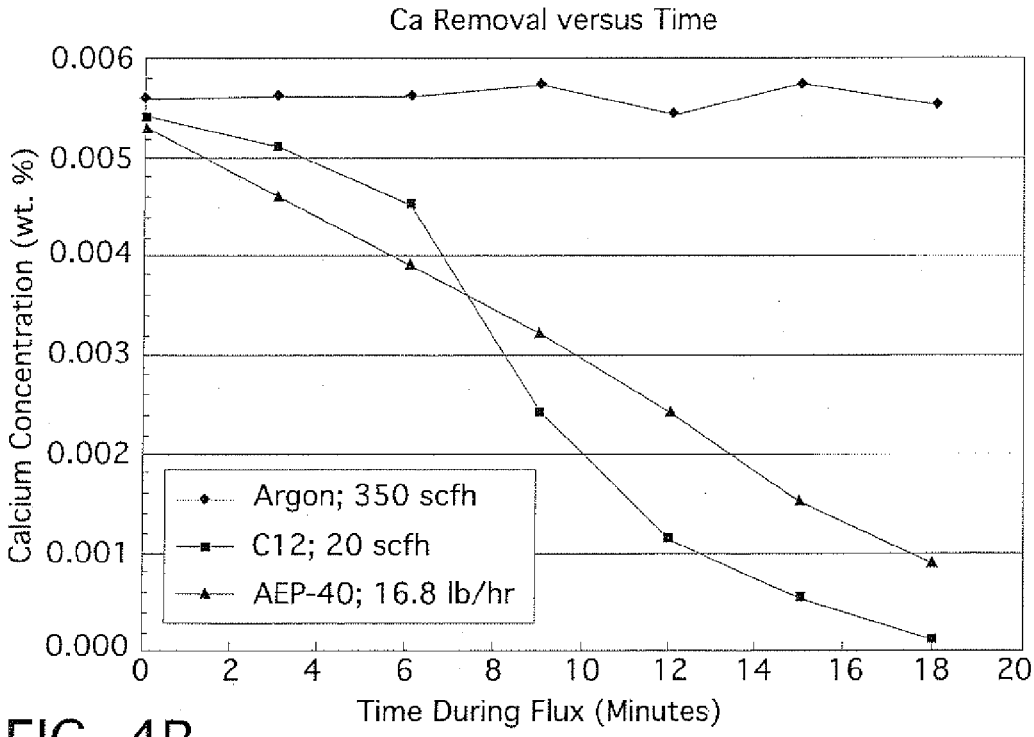

FIGS. 4A and 4B show examples of the Na and Ca concentrations (in the molten metal), respectively, versus time for Ar alone, about 20 scfh $Cl_2$ in Ar, and about 16.8 lb/hr of AEP-40 (40% $MgCl_2$) salt in Ar in a batch mode testing according to one embodiment. The plot in FIG. 4A relates to results of removal of Na in the batch testing mode, whereas the plot in FIG. 4B relates to results of removal of Ca in the batch testing mode. It is seen from the plots in FIGS. 4A-4B, respectively, that with only Ar flowing into the molten metal (through the rotor of A622), there was some removal of Na due to the high vapor pressure of Na at molten aluminum temperature. The removal rate of Na with Ar alone was, however, considerably slower than that obtained when a combination of Ar with either $Cl_2$ or AEP-40 salt was used. It is noted with reference to the plot in FIG. 4B that there was no significant removal of Ca with Ar alone. It was evident from these plots that some flux must be added to the Ar to effectively remove Na and Ca in-line. It is seen from the plot in FIG. 4A that a combination of Ar with halide salt flux (AEP-40) according to one embodiment of the present disclosure performed substantially similar to the combination of Ar with $Cl_2$ in removing the Na from the molten metal. However, in case of the removal of the Ca, it is seen from the plot in FIG. 4B that the Ar—$Cl_2$ combination resulted in somewhat more removal of Ca than the Ar and AEP-40 combination. However, upon comparison, it is seen that the Ca removal using the salt reactant was still significantly close to that achieved using the Ar—$Cl_2$ combination.

In the second phase of testing, the same A622 degasser was used, but in a dynamic or continuous mode. As noted before, in the dynamic mode, the molten metal flowed from a 10,000 lb. furnace through the A622 into drain pans at a controlled rate of about 10,000 Ib/hr. In the dynamic mode testing, Na and Ca were added to the metal in the furnace before each test. Quantometer, Ransley, and PoDFA (Porous Disk Filtration Apparatus) samples were taken before and after the A622 degassing operation to analyze for Na, Ca, $H_2$, and for inclusions. LiMCA (Liquid Metal Cleanliness Analyzer) was used to provide continuous measurement of inclusion concentrations upstream and downstream of the A622. Emission tests for particulate, HCl, and $Cl_2$ were also done during the dynamic test phase. For the dynamic tests, two salt compositions were chosen for comparison to $Cl_2$ injection. The AEP-27 salt (blended about 40% of $MgCl_2$) from Amcor™ was chosen as one of the salt compositions. To determine if fused salts are more effective then blended salts, the AEP-40 (fused about 40% $MgCl_2$) salt was chosen as the second salt composition. In the dynamic testing, the target furnace concentrations were about 0.003 wt. % each of Na and Ca; however, the actual incoming levels (in the molten metal received into A622 from the furnace) were typically about 0.005 wt. % Na and about 0.004 wt. % Ca. The A622 was filled before the salt injector was started and the time required for the salt to pass through the hoses and rotor to be dispersed into the metal was taken into account.

Figure 5A:
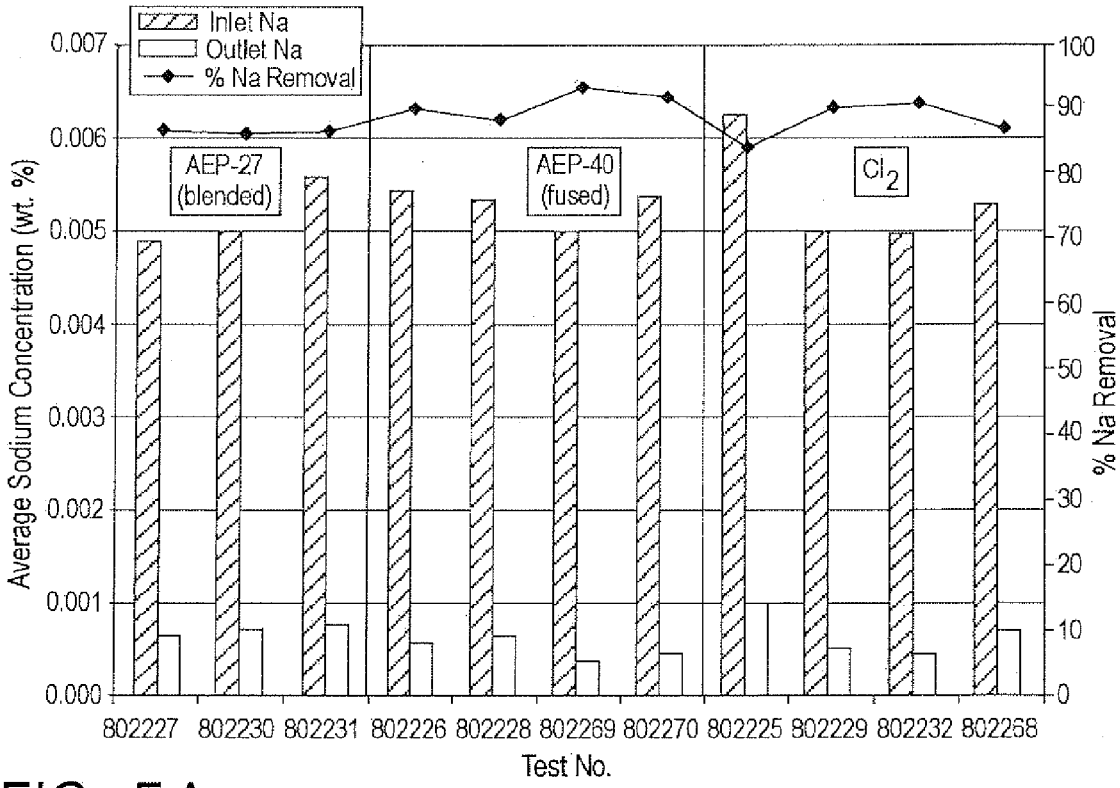
FIGS. 5A and 5B illustrate the inlet (i.e., prior to degassing) and outlet (i.e., after degassing is carried out) concentrations and the percent removal of Na and Ca for each dynamic test (listed along the x-axis in the plots in FIGS. 5A-5B) according to one embodiment of the present disclosure.
Figure 5B:
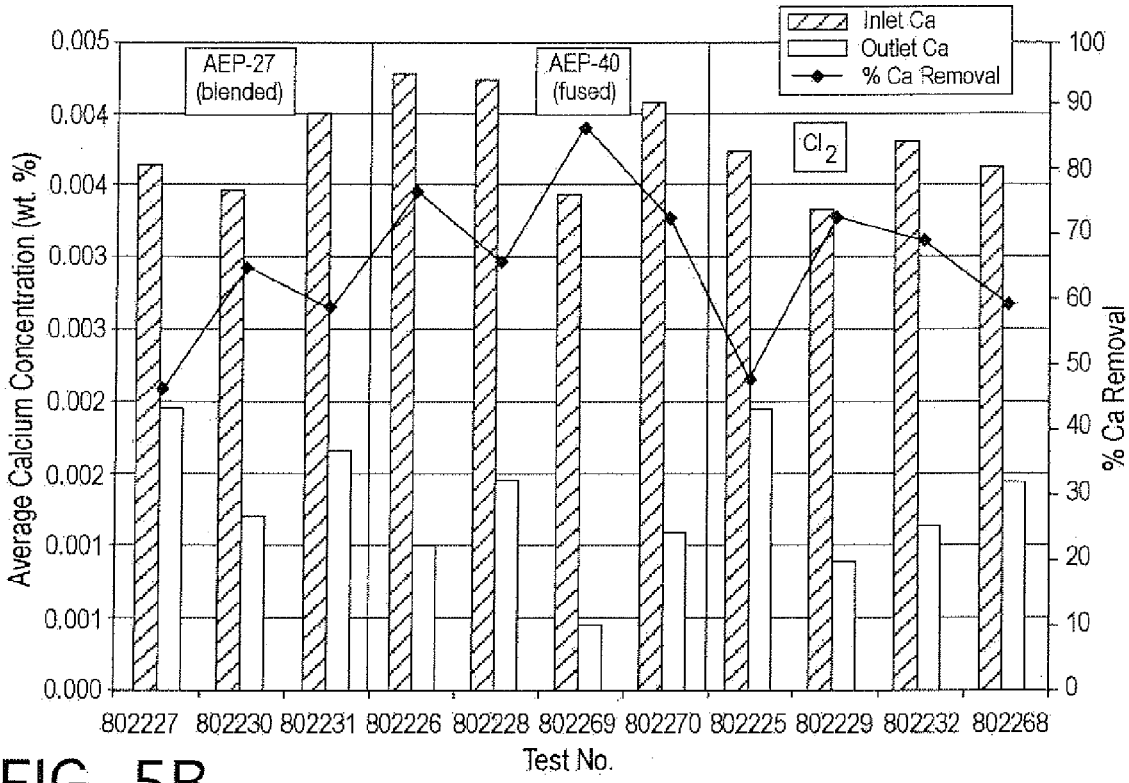

FIGS. 5A and 5B illustrate the inlet (i.e., prior to degassing) and outlet (i.e., after degassing is carried out) concentrations and the percent removal of Na and Ca for each dynamic test (listed along the x-axis in the plots in FIGS. 5A-5B) according to one embodiment of the present disclosure. The Na results are plotted in the top plot (FIG. 5A) and Ca results are plotted in the bottom plot (FIG. 5B). It is seen from the plot in FIG. 5A that, among the three reactants (i.e., the AEP-27 salt, the AEP-40 salt, and gaseous $Cl_2$), Na removal efficiencies ranged from about 84% to 93%, averaging at about 89%. As noted before, a different one of the three reactants was mixed with Argon during corresponding test(s) in the plots in FIGS. 5A-5B. The Ca removal efficiency, however, ranged from about 48% to 87%, averaging at about 68%. Statistical analyses indicate that there were no significant differences in Na and Ca removal efficiencies for the three reactants (i.e., the two salts AEP-27 and AEP-40, and $Cl_2$) in FIGS. 5A and 5B. However, in comparison, the fused salt (AEP-40) performed better than the other two reactants as can be seen from the plots in FIGS. 5A-5B, respectively. The fused salts may be more effective because, in the fused salts, the mixture (of salt ingredients) is melted, solidified, crushed, and sized.

Figure 6:
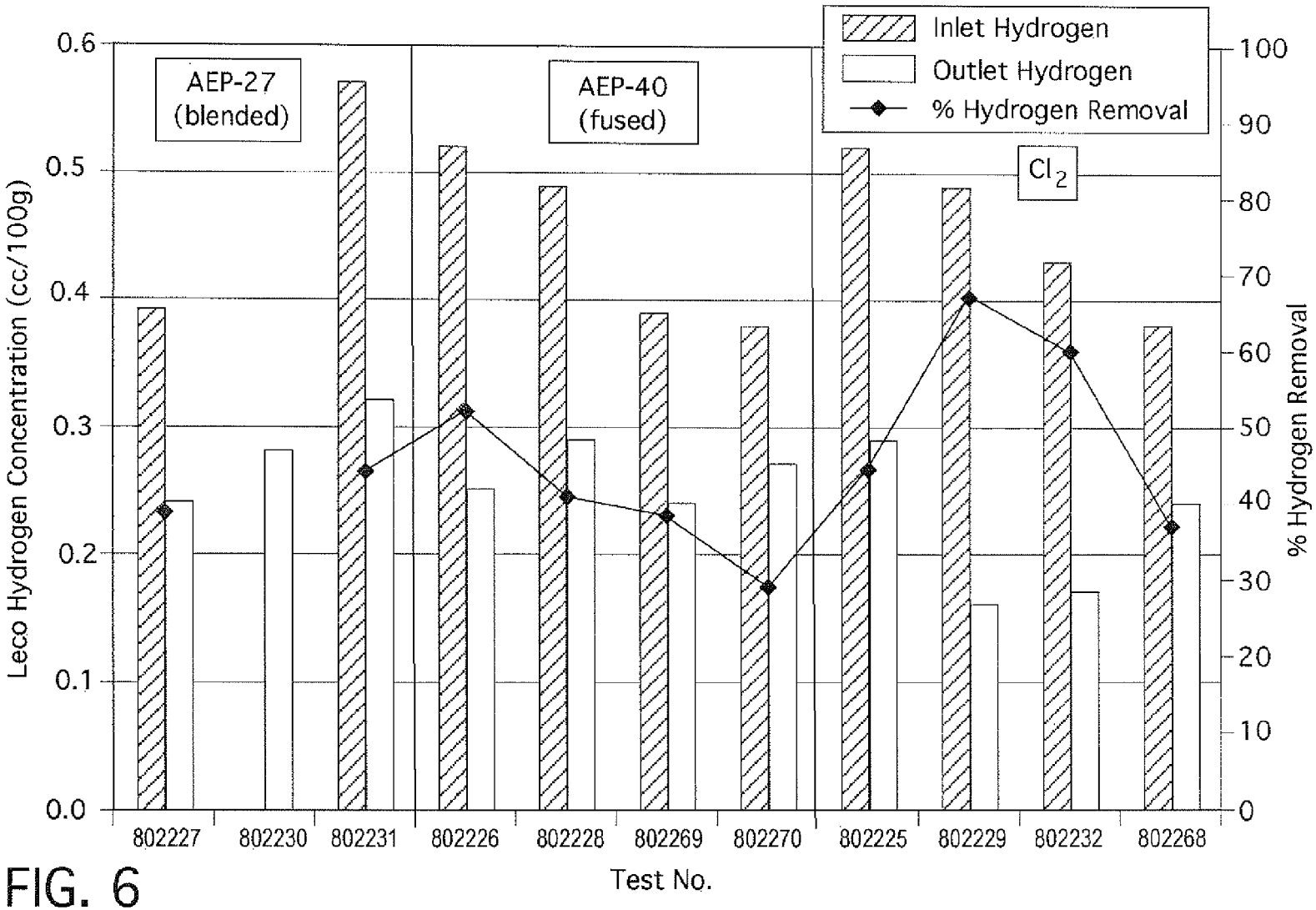
FIG. 6 shows an exemplary plot that summarizes the hydrogen removal results from various dynamic tests according to one embodiment of the present disclosure.

FIG. 6 shows an exemplary plot that summarizes the hydrogen removal results from various dynamic tests according to one embodiment of the present disclosure. As noted before, during the dynamic tests, Ar was fed into degasser with a different one of three reactants (two salts AEP 27 and AEP-40, and the gaseous $Cl_2$) depending on the test (indicated on the x-axis in the plot in FIG. 6). Ransley samples were taken at the beginning, middle, and end of each test. However, only the samples taken in the middle of a test were analyzed for $H_2$ by Leco™. Incoming $H_2$ (in the molten metal from the furnace) was generally about 0.4 to 0.5 cc/100 g. It is seen from the plot in FIG. 6 that, among the three reactants, the $H_2$ removal efficiency ranged from about 29% to 67%, averaging at about 45%. Statistical analyses indicated that there were no statistically significant differences in $H_2$ removal, efficiencies for the three reactants. However, it can be seen from, the plot in FIG. 6 that the fused salt (AEP-40) performed better than the other two reactants in reducing the $H_2$ concentration from the inlet molten metal.

Figure 7:
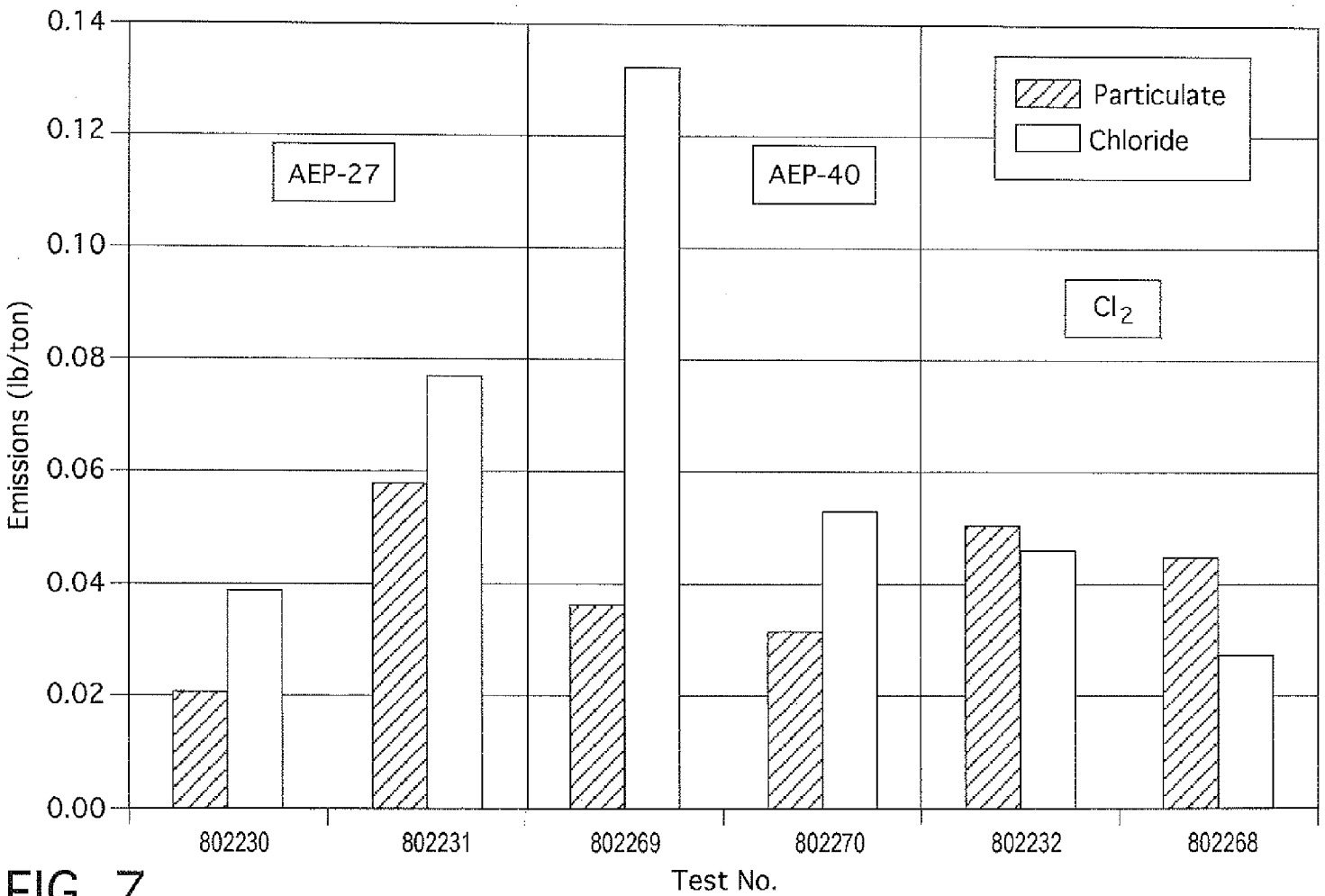
FIG. 7 illustrates an exemplary plot depicting particulate and chloride emissions values during six different dynamic tests involving three reactants (two salts and the chlorine gas; two tests per reactant), each combined with the Ar gas for degassing during the corresponding pair of tests according to one embodiment of the present disclosure.

In one embodiment, emission tests for particulate matter, HCl (chloride), and chlorine gas were conducted during six dynamic injection tests. FIG. 7 illustrates an exemplary plot depicting particulate and chloride emissions values during six different dynamic tests involving three reactants (two salts and the chlorine gas; two tests per reactant), each combined with the Ar gas for degassing during the corresponding pair of tests according to one embodiment of the present disclosure. It is seen from the x-axis in the plot in FIG. 7 that two dynamic tests were carried out per reactant. It is observed with reference to the plot in FIG. 7 that most of the chloride (e.g., HCl) values and all of the particulate values exceed the Secondary MACT limits for degassers of about 0.04 lb/ton of HCl and about 0.01 lb/ton particulate. Some of the reasons for such higher values may be: (1) the A622 unit was not sealed during degassing, (2) the high equivalent $Cl_2$ flows contributed to the high chloride values, and (3) the relatively long residence time of the molten metal in the A622 due to the low metal flow rate. It is, however, seen from the plot in FIG. 7 that emissions with the salts were not significantly higher than those with $Cl_2$. Hence, in one embodiment, the emissions could be obtained within the Secondary MACT limits if the degassing process were earned out in a sealed A622. Furthermore, it is noted that there were no statistically significant differences in emissions between the blended (AEP-27) and the fused (AEP-40) salts.

Figure 8:
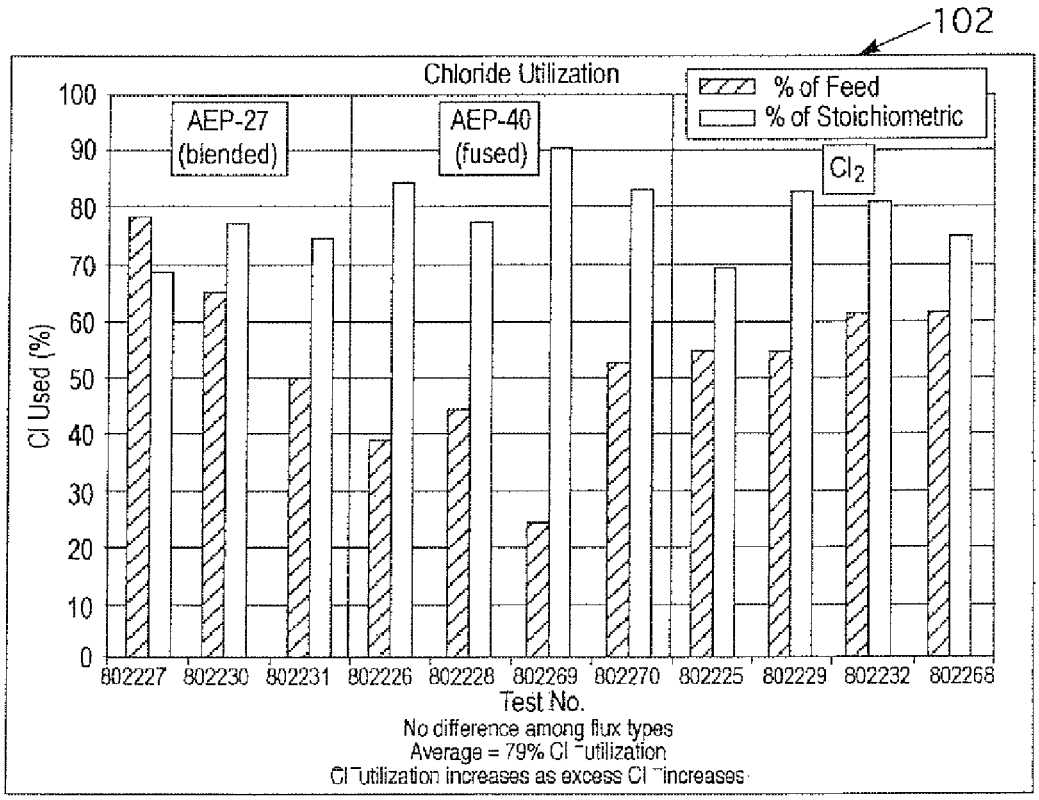
FIG. 8 shows an exemplary plot depicting chloride utilization with three reactants (two halide salts and the gaseous chlorine, each combined with Ar gas) during a number of dynamic tests according to one embodiment of the present disclosure.

FIG. 8 shows an exemplary plot depicting chloride utilization with, three reactants (two halide salts and the gaseous chlorine) during a number of dynamic tests according to one embodiment of the present disclosure. The chloride utilization for the AEP-27 salt was calculated for three dynamic tests, whereas the chloride utilizations for the AEP-40 salt and gaseous chlorine were calculated for four dynamic tests each as can be seen from the x-axis in the plot in FIG. 8. In one embodiment, the amount of Cl (chloride or HCl) used was calculated as:

$$\text{Cl Used (lb/hr)}=F*\{[(Na_{in}-Na_{out})*35.45\text{ lb Cl}/23\text{ lb Na}]+[(Ca_{in}-Ca_{out})*70.9\text{ lb Cl}/40.1\text{ lb Ca}]\}$$

In the above equation, F is the metal flow rate in lb/hr; $Na_{in}$ and $Ca_{in}$ are the incoming Na and Ca concentrations as weight fractions (wt. %/100); $Na_{out}$ and $Ca_{out}$ are the outlet Na and Ca concentrations in the same measurement units. In one embodiment, Cl (chloride) used as a percent of the stoichiometric requirement ranged from about 69 to 90%, averaging at about 79% Cl utilization. It is seen from FIG. 8 that there were no statistically significant differences among the two salts and $Cl_2$ in terms of chloride utilization. In particular, Cl utilization with AEP-40 was clearly not less than with AEP-27 or $Cl_2$. Furthermore, chloride utilization increased as excess chloride (in the molten metal) increased during degassing.

Figure 9:
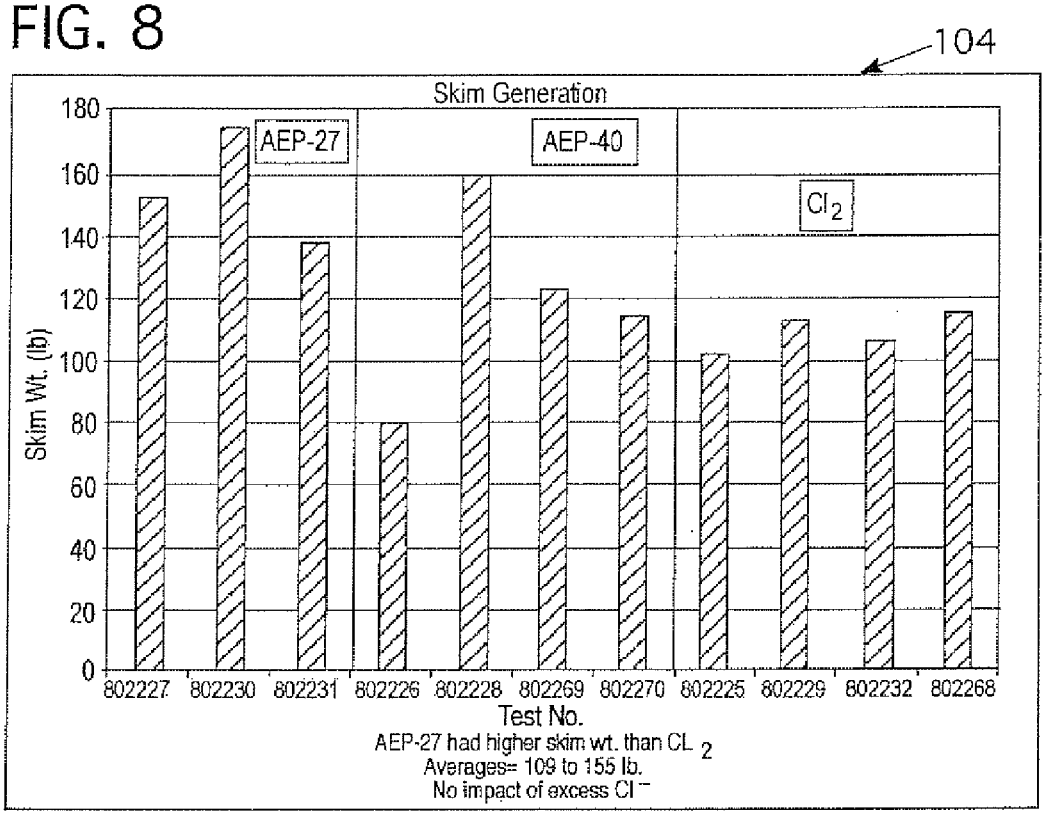
FIG. 9 illustrates an exemplary plot depicting skim generation test results for three reactants (two halide salts and the gaseous $Cl_2$, each combined with Ar gas) during a number of dynamic tests according to one embodiment of the present disclosure.

FIG. 9 illustrates an exemplary plot depicting skim generation test results for three reactants (two halide salts and the gaseous $Cl_2$) during a number of dynamic tests according to one embodiment of the present disclosure. The skim generation for the AEP-27 salt was calculated for three dynamic tests, whereas the skim, generations for the AEP-40 salt and gaseous chlorine were calculated for four dynamic tests each as can be seen from the x-axis in the plot in FIG. 9. It is observed with reference to FIG. 9 that skim weights ranged from about 80 to 175 lbs. A statistical analysis indicated that AEP-27 produced a higher average skim weight (about 155 lbs) than $Cl_2$ (about 109 lbs). Skim generation with halide salt-based flux reactants may be higher because the A622 degasser unit was not sealed during testing. It is noted here that excess chloride (Cl) in the molten metal had almost no impact on skim generation.

Figure 10A:
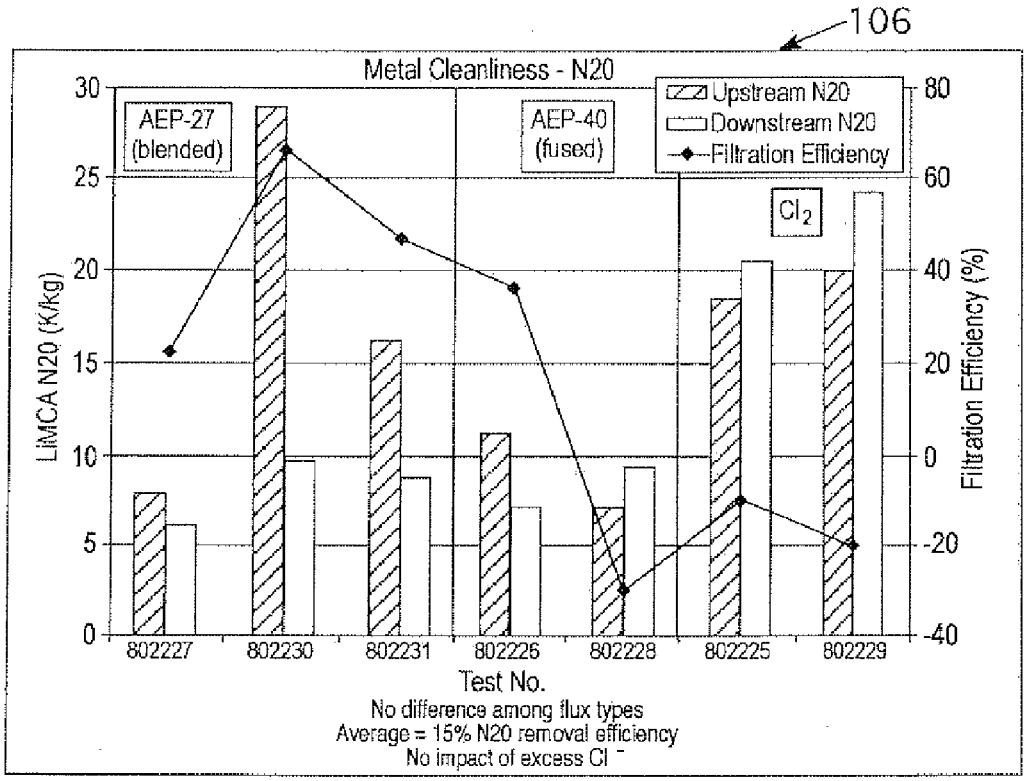
FIGS. 10A-10B show exemplary plots illustrating metal cleanliness test results for three reactants (two halide salts and the gaseous chlorine) during a number of dynamic tests according to one embodiment of the present disclosure.
Figure 10B:
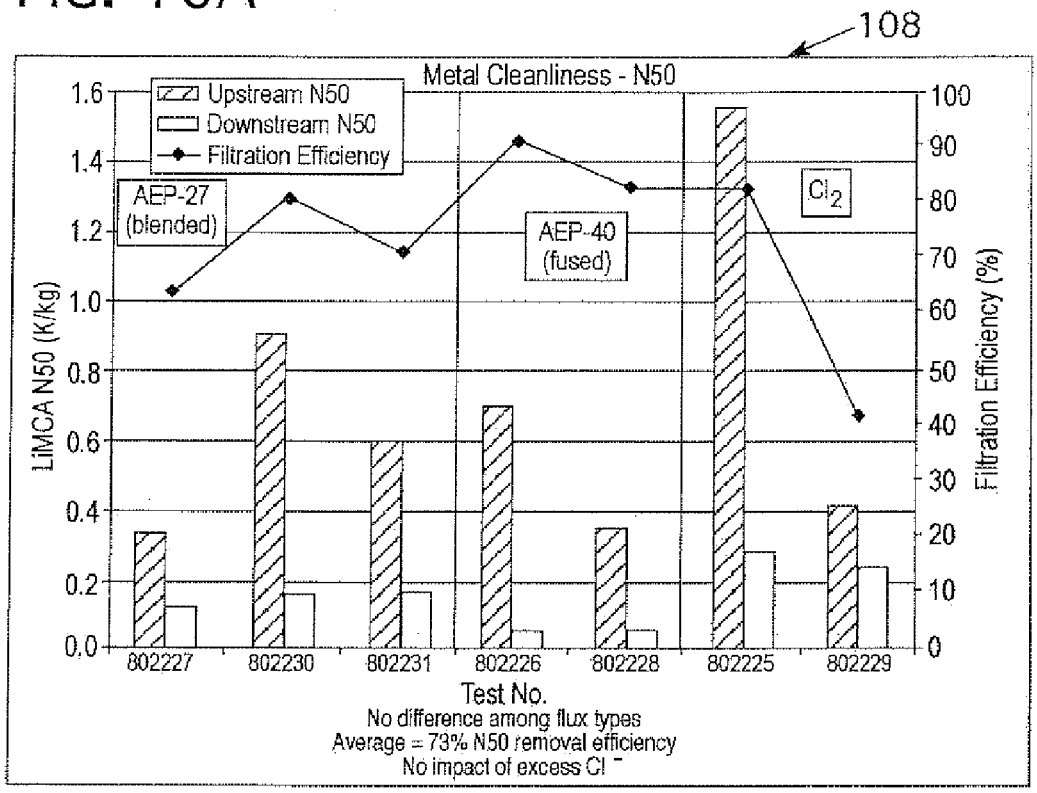

FIGS. 10A-10B show exemplary plots illustrating metal cleanliness test results for three reactants (two halide salts and the gaseous chlorine) during a number of dynamic tests according to one embodiment of the present disclosure. In one embodiment, LiMCA was used to monitor molten metal cleanliness upstream (i.e., prior to degassing) and downstream (i.e., subsequent to degassing) of the A622 degasser during seven dynamic tests, which are listed along the x-axis in the plots in FIGS. 10A-10B. In the plots in FIGS. 10A-10B, the terms "N20" and "N50" represent the concentrations of particles larger than 20 and 50 microns, respectively, in the molten metal being tested for cleanliness. Average values of N20 and N50 for each test was given in K/kg (thousands of particles per kilogram of molten metal). It is observed from the plots in FIGS. 10A-10B that tests with $Cl_2$ had higher N20 values downstream of the A622 than tests with halide salts. Statistical results indicated that there were no significant differences in the upstream LiMCA values among the three reactants. Downstream of the A622, the values for N20 and N50 were significantly higher with $Cl_2$ than with either of the salts. Although plots are not shown for N100, it is noted here that there were no differences among the three reactants for downstream values for N100. For N50, the AEP-40 salt had significantly lower downstream values than those obtained with the AEP-27 salt. The filtration efficiency of the A622 degasser increased with increasing particle size. FIGS. 10A-10B also show linear plots of filtration. efficiency superimposed on the metal cleanliness histograms. It is observed that negative filtration efficiency for N20 in some of the tests implies that the A622 degasser unit added particles on that size range. These particles may be $MgCl_2$ salt droplets, argon microbubbles, or the NaCl and $CaCl_2$ particles that are the reaction products. On average, the A622 unit removed about 73% of the particles larger than 50 microns (N50) and 93% of the particles larger than 100 microns (N100) (not shown). In another inclusion measurement technique, PoDFA samples were taken upstream and downstream of the A622 degasser to allow microscopic examination of the types of inclusions present in the metal. The occurrence of salt droplets was of particular interest. Neither salt reactant generated more salt droplets in the metal than were formed from $Cl_2$ addition. The possible presence of chlorides (Cl) was noted in most of the samples. Since the normal aqueous polishing technique may remove chlorides, they cannot be distinguished from microbubbles unless the samples are dry-polished and analyzed by SEM. Statistical analyses indicated that although the downstream chloride concentrations were higher than the upstream values, there were no significant differences in the chloride concentrations among the three reactants as noted in the plots in FIGS. 10A-10B.

From the discussion of FIGS. 5 through 10 above, it can be observed that injection of $MgCl_2$-containing salts (into the molten metal) through the rotor of an A622 degasser can provide Na and Ca removal similar to that obtained with an equivalent amount of gaseous $Cl_2$. The chloride content of the salts was used efficiently for Na and Ca removal with about 75 to 85% utilization. Hydrogen removal and skim generation with salt additions were the same as those obtained with equivalent $Cl_2$ flows. There were no differences in particulate emissions among the three reactants ($Cl_2$, fused salt AEP-40, and blended salt AEP-27). However, salt addition produced cleaner metal than $Cl_2$ addition, as measured by LiMCA. There were no statistically significant differences among the two salts and $Cl_2$ in terms of chloride (Cl) utilization. Furthermore, there were no significant differences in performance between fused and blended salts. A wide range of salt particle sizes could be effectively fed through the rotor injector system of the A622 degasser.

The foregoing describes an in-line treatment of molten metal wherein, instead of gaseous $Cl_2$, a solid salt reactant containing a halide salt (e.g., $MgCl_2$) as one of its components may be injected into the molten metal along with an inert gas (typically argon) through the existing degasser impellor. The inert gas stream to the degasser, which is used for $H_2$ removal, may also be used to fluidize and transport the solid salt reactant through a rotary coupling into the degasser shaft. The salt flux may be metered into the inert gas stream at a controlled rate. The $MgCl_2$ portion of the salt may react with alkali and alkaline earth metals to remove them from the molten metal as chlorides. Using a halide salt-based reactant according to one embodiment of the present disclosure, the removal of alkali and alkaline earth may be equal to that attained with the equivalent amount of gaseous $Cl_2$. Furthermore, non-metallic inclusion removal with a salt reactant may be equal to or better than that attained with an equivalent amount of gaseous $Cl_2$. Hydrogen removal may be unaffected by the addition of the salt to the inert gas stream. Thus, using the halide salt-based solid flux as per the teachings of one embodiment of the present disclosure, the benefits of alkali, alkaline earth, and inclusion removal may be achieved without the industrial hygiene, environmental, and safety issues associated with storing and using the gaseous and hazardous $Cl_2$ during molten metal degassing.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A method of processing a molten metal, the method comprising:

continuously flowing the molten metal in and out of a compartment; and continuously injecting a fluidized salt reactant comprising a halide salt and an inert gas into the compartment, wherein the fluidized salt reactant is continuously fed at a rate of about 20 scfh to about 200 scfh into the molten metal.

2. The method of claim 1, wherein the inert gas is argon (Ar), and wherein the molten metal is selected from the group consisting of aluminum, aluminum alloys, magnesium, and magnesium alloys.

3. The method of claim 1, wherein the halide salt is selected from the group consisting of magnesium chloride ($MgCl_2$), potassium chloride (KCl), aluminum fluoride ($AlFl_3$), sodium chloride (NaCl), calcium chloride ($CaCl_2$), sodium fluoride (NaF), and calcium fluoride ($CaF_2$).

4. The method of claim 1, wherein the step of continuously injecting the fluidized salt reactant comprises:

continuously transporting the fluidized salt reactant into the molten metal through an impeller immersed into the molten metal.

5. The method of claim 1, wherein the step of continuously injecting the fluidized salt reactant comprises adjusting the flow rate.

6. The method of claim 1, wherein the step of injecting a fluidized salt reactant comprises continuously injecting a fluidized salt reactant at a flow rate in the range of about 100 to about 150 scfh.

7. The method of claim 1, wherein the fluidized salt reactant contains the halide salt in a blended form.

8. The method of claim 1, wherein the fluidized salt reactant contains the halide salt in a fused form.

9. The method of claim 1, further wherein prior to injecting, the method comprises:

storing the inert gas and the halide salt in a tank.

10. The method of claim 9, further comprising the step of pressurizing the tank to an operating pressure of about 3 to 7 psig.

11. The method of claim 1, wherein continuously flowing the molten metal in and out of a compartment comprises continuously flowing the molten metal in and out of a compartment having a static depth to dynamic depth ratio greater than about 0.5.

* * * * *